United States Patent [19]

Wu

[11] Patent Number: 4,878,162

[45] Date of Patent: Oct. 31, 1989

[54] NIGHT LIGHT LAMP-SHADE

[76] Inventor: Arthur S. Wu, No. 11, Alley 8, Shiway Lane, Chung Chang Rd., Shin Ten City, Taipei Shien, Taiwan

[21] Appl. No.: 295,991

[22] Filed: Jan. 12, 1989

[51] Int. Cl.[4] ..... F21V 1/06

[52] U.S. Cl. ..... 362/352; 362/226; 362/353; 362/360; 362/443

[58] Field of Search ..... 362/226, 351, 352, 353, 362/360, 443, 448, 450; D26/26, 118

[56] References Cited

U.S. PATENT DOCUMENTS

| | | | |
|---|---|---|---|
| D. 205,371 | 7/1966 | Mellyn | D26/26 |
| 2,075,364 | 3/1937 | Smith | 362/226 |
| 2,166,790 | 7/1939 | Benander | 362/226 |
| 2,905,779 | 9/1959 | Schmier | D26/26 |
| 4,343,032 | 8/1987 | Schwartz | 362/226 |

*Primary Examiner*—Stephen F. Husar
*Assistant Examiner*—Richard R. Cole
*Attorney, Agent, or Firm*—Notaro & Michalos

[57] ABSTRACT

The present invention relates to a night light lamp-shade which is consisted of a main body and a lamp-shade, wherein the lamp-shade includes a base which can be connected with the main body, a front plate and two side plates which can be engaged with each other and then be inserted in the channels of the base for a convenient way to assemble a detachable lamp-shade.

1 Claim, 3 Drawing Sheets

NIGHT LIGHT LAMP-SHADE

BACKGROUND OF THE INVENTION

The present invention relates to a night light lamp-shade, and more particularly to an associated lamp-shade which can be easily gotten united.

In prior art, there are many lamp-shades with different structures and a known structure of night light is shown in FIG. 1. The night light, as in FIG. 1, has a main body which connects with a light and has a pair of plug extended thereof for participating in a receptacle. The lamp-shape is consisted of a base, a front plate and two side plates, wherein the base has a semi-circular aperture for engaging with the neck of main body. The front plate and two side plates are welded together in their respective sides and then jointed with solder in their bottom on the sides of the said base. Another well known structure of night light is shown as in FIG. 2. It has separatedly front plate and both side plates wherein every plate has provided with a hole on its bottom. The seat of the known lamp-shade is formed a U-shaped base and mounted with respective flange having bolt hole thereof on each side. Then, the three plates are connected with the base by three screws.

SUMMARY OF THE INVENTION

The primary objective of the present invention is to provide a night light lamp-shade which can be manufactured rapidly and conveniently.

Another objective of the present invention is to provide a night light lamp-shade which comprises a front plate and two side plates which can be engaged together and then engaged fixedly and detachably with the base which is formed a single piece so as to be made easily.

A further objective of the present invention is to provide a night light lamp-shade wherein the plates of it are replaceable during damage in a simple way.

Other objectives and advantages of the present invention will become apparent from a study of the following specification in conjunction with the accompanying drawings.

DETAILED DESCRIPTION OF THE PREFERRED EMBODIMENT

Figure 1:
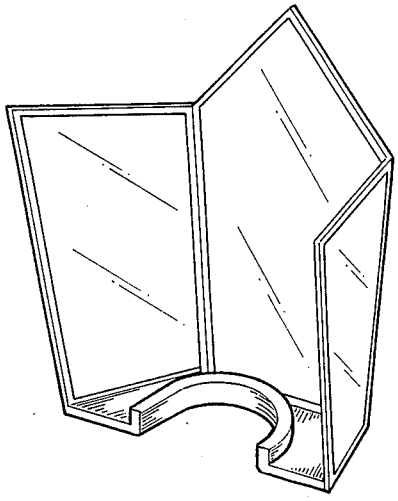
Fig. 1 PRIOR ART
FIG. 1 is a perspective view of a prior known structure of the night light lamp-shade.
Figure 2:
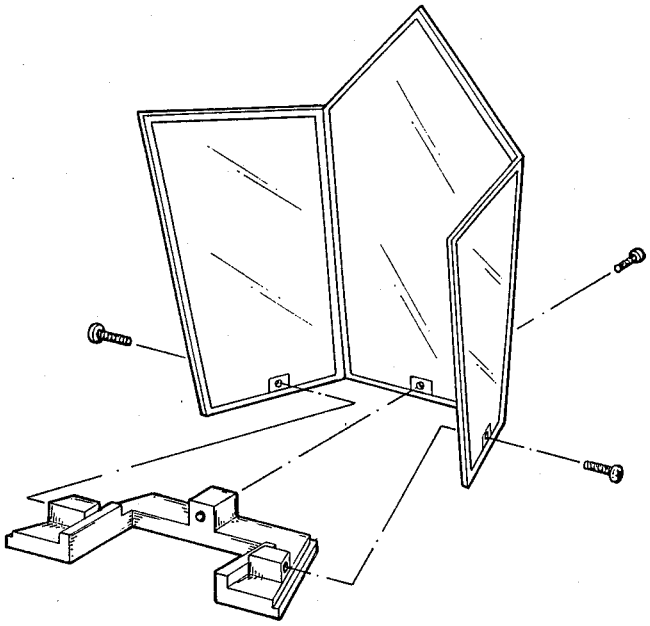
Fig. 2 PRIOR ART
FIG. 2 is another perspective view of another known lamp-shade of prior art.
Figure 3:
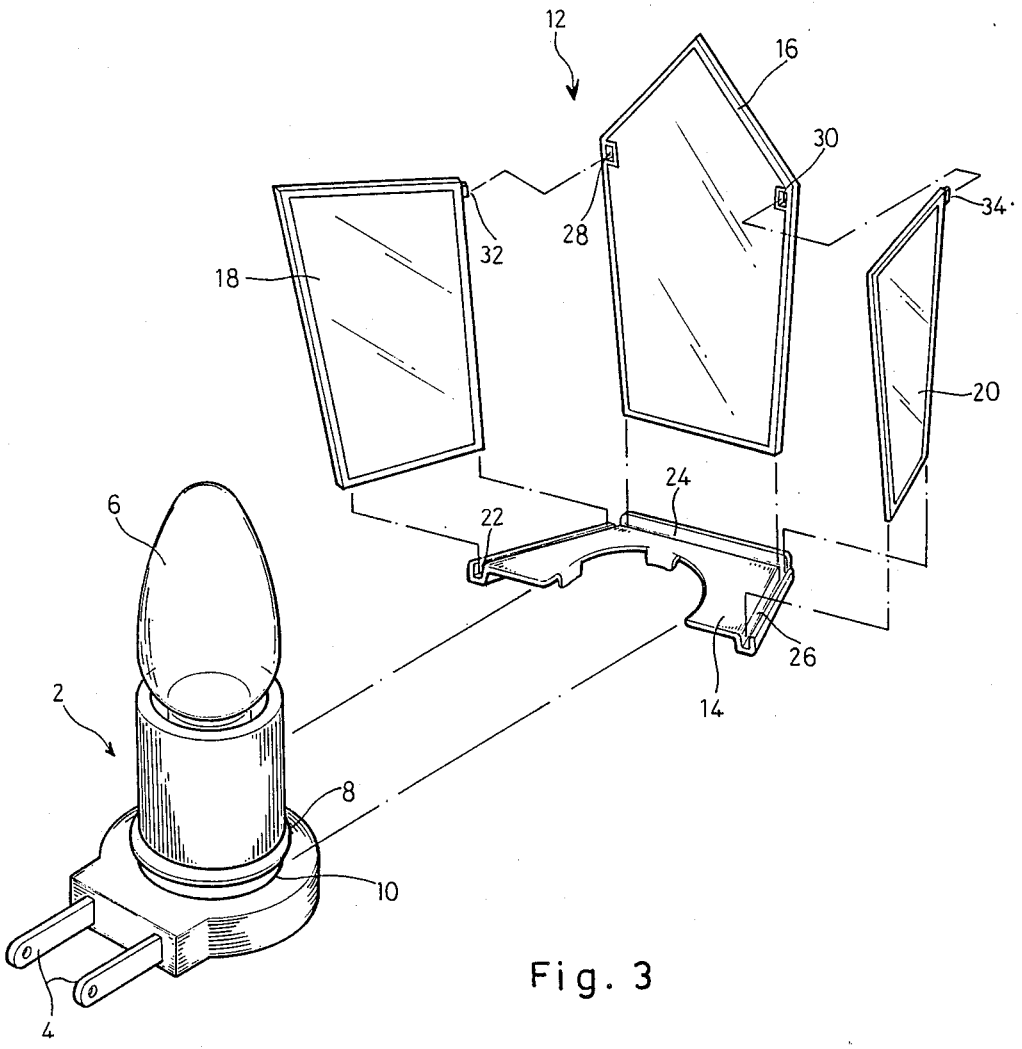
FIG. 3 is a perspective fragmentary view of the lamp-shade in accordance with the present invention.

Now referring to FIG. 3, the night light lamp-shade of the present invention includes a main body (2) which is the same as prior art having a pair of plugs (4) extended thereof for participating in any receptacle and connecting with a light (6) thereof. Also, an annular flange (8) is formed around the bottom side of the main body (2) and wherein a neck (10) is made between the flange (8) and the bottom of the body (2). The charcteristic of the present invention is in that the lamp-shade (12) is consisted of a base (14), a front plate (16) and two side plates (18), (20). The said base (14) is trapezoidal and provided with channels (22), (24), (26) at three sides. The last (long) side of the base (14) is provided with a semi-circular aperture and three symmetrical arcurate contact members extended downwards. The base (14) is capable of engaging with the main body (2) by the combination of the semi-circular aperture and neck (10) and wherein three said arcurate contact members are elastically pressing the neck (10) to obtain a fixedly and detachable connection.

The said front plate (16) has its bottom to be inserted into the channel (24) stably and is provided with two snap holes (28) (30). The side plates (18) (20) also have their bottom to be engaged with the channels (22) (26) respectively and are formed with two tabs (32) (34) on one side of each of them for insertion into the snap holes (28) (30) of the front plate (16) respectively. Therefore, the lamp-shade of the present invention is easily assembled.

As mentioned above, the night light lamp-shade in accordance with the present invention has many advantages as following: (a) It can be manufactured in a large amounts quickly and cheaply. (b) It can be assembled by anyone in an easy way without skilled technology. (c) The plates of the lamp-shade are individually replacable whenever they are broken.

The invention and its attendent advantages will be understood from the foregoing description; and it will be apparent that various changes may be made in the form, construction and arrangement of the parts of the invention without departing from the spirit and scope thereof, the arrangement hereinbefore described being merely by way of example; and we do not wish to be restricted to the scpeific form shown or uses mentioned, except as defined in the accompanying claim.

I claim:

1. A night light lamp-shade comprising a main body having a pair of plugs extended and connecting with a light thereon and a lamp-shade, characterized in that the lamp-shade consists of a base, a front plate and two side plates, wherein the base is trapezoidal and provided with channels at three sides while a fourth (long) side is formed with a semi-circular aperture and mounted with three symmetrical contact members; the three plates are engaged with the channels of the base and connected with each other in use of the tabs mounted on the side plates and snap holes formed on the front plate.

* * * * *